US007679016B2

(12) United States Patent
Karaki et al.

(10) Patent No.: US 7,679,016 B2
(45) Date of Patent: Mar. 16, 2010

(54) PANEL SWITCH

(75) Inventors: Minoru Karaki, Okayama (JP); Takahiro Nishimura, Okayama (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/356,211

(22) Filed: Jan. 20, 2009

(65) Prior Publication Data

US 2009/0205943 A1 Aug. 20, 2009

(30) Foreign Application Priority Data

Feb. 18, 2008 (JP) ..... 2008-035590

(51) Int. Cl.
*H01H 13/70* (2006.01)

(52) U.S. Cl. ..... 200/516; 200/512

(58) Field of Classification Search ..... 200/406, 200/512, 516, 517, 515
See application file for complete search history.

(56) References Cited

U.S. PATENT DOCUMENTS 4,046,975 A * 9/1977 Seeger, Jr. ..... 200/515
4,415,780 A * 11/1983 Daugherty et al. ..... 200/5 A
4,916,262 A * 4/1990 Jungels-Butler et al. .... 200/5 A
4,931,601 A * 6/1990 Lavender ..... 200/83 N
5,901,834 A * 5/1999 Inubushi et al. ..... 200/314
6,700,086 B2 * 3/2004 Serizawa et al. ..... 200/512
6,730,869 B2 * 5/2004 Teruyama et al. ..... 200/516
6,768,074 B2 * 7/2004 Iwama ..... 200/515
6,917,007 B2 * 7/2005 Hirai et al. ..... 200/516
6,982,394 B2 * 1/2006 Ide et al. ..... 200/516
7,230,197 B2 * 6/2007 Sano et al. ..... 200/406
7,399,937 B2 * 7/2008 Nishimura ..... 200/314
7,504,603 B2 * 3/2009 Lung ..... 200/512

FOREIGN PATENT DOCUMENTS

JP 2001-035305 A 2/2001

* cited by examiner

*Primary Examiner*—Michael A Friedhofer
(74) *Attorney, Agent, or Firm*—RatnerPrestia

(57) ABSTRACT

A panel switch includes an insulating substrate, a resist layer provided on an upper surface of the insulating substrate, a cover sheet, an adhesive layer bonded onto an upper surface of the resist layer, and plural push switches activated upon being pressed via the cover sheet. The resist layer has plural contact openings and a communication opening provided therein. The contact openings and the communication opening exposes the upper surface of the insulating substrate from the contact openings and the communication opening. The communication opening allows the contact openings to communicate with each other. The adhesive layer is provided entirely on a lower surface of the cover sheet and covers the contact openings and the communication opening. The push switches are accommodated in the contact openings, respectively. In this panel switch, the adhesive layer can easily be printed on the cover sheet and bond the cover sheet securely to the insulating substrate.

6 Claims, 8 Drawing Sheets

PANEL SWITCH

FIELD OF THE INVENTION

The present invention relates to a panel switch for use in a thin electronic appliance, such as a portable telephone.

BACKGROUND OF THE INVENTION

FIGS. 4 and 5 are a cross sectional view and an exploded perspective view of a conventional panel switch 501, respectively. Stationary contacts 2 are provided on an upper surface of an electrically insulating substrate 1. Each of stationary contacts 2 includes an inner stationary contact 2A and an outer stationary contact 2B spaced by a distance between stationary contacts 2A and 2B. A resist layer 3 is provided on the upper surface of the insulating substrate 1 by printing and applying insulating material. The resist layer 3 has circular openings provided therein exposing stationary contacts 2, respectively. The openings are independently separated from each other one another and are not communicated with each other. Movable contacts 4 are made of elastic metallic material. Each contact 4 having a circular dome shape opening downward. The center of a lower surface of movable contact 4 is located above inner stationary contact 2A of stationary contact 2 by a distance. Movable contact 4 and stationary contact 2 provides a single switch.

Adhesive layer 6 is provided on a lower surface of cover sheet 1. Cover sheet 5 is bonded with the adhesive layer 6 onto the upper surface of the insulating substrate 1 so that movable contacts 4 are sandwiched between the cover sheet 5 and the insulating substrate 1.

FIG. 6 is a top view of the cover sheet 5. The adhesive layer 6 is formed by screen printing on the lower surface of the cover sheet 5. Circular adhesives 6A are provided on the lower surface of cover sheet 5 for holding the centers of movable contacts 4 to adhere onto the lower surface of the cover sheet 5, respectively. Air passages 7 where the adhesive layer 6 is not formed to expose the lower surface of cover sheet 5 are provided on the lower surface of the cover sheet 5. The air passage 7 includes ring portions 8 corresponding to the outlines of the movable contacts 4 and communicating portions 9 for communicating ring portions 8 adjacent to each other, thereby allowing movable contacts 4 to communicate with each other.

An operation of conventional panel switch 501 will be described below. Upon being pressed down at the center across the cover sheet 5, the movable contact 4 receives a pressing force. As the pressing force exceeds a predetermined level, the dome shape of the movable contact 4 elastically reversed with a light click feel. Then, the lower surface at the center of the movable contact 4 contacts the inner stationary contact 2A, thereby connecting electrically between the inner stationary contact 2A and the outer stationary contact 2B via the movable contact 4, thus turning on the switch 501.

When the pressing force applied to the cover sheet 5 is released, the dome shape of the movable contract 4 elastically returns back to its original shape which is upwardly convex with a light click feel. Consequently, the lower surface at the center of the movable contact 4 departs from the inner stationary contact 2A, as shown in FIG. 4, thus turning off the switch 501.

Since the cover sheet 4 covers the upper surface of the insulating substrate 1, the air trapped between the insulting substrate 1 and the lower concave surface of the movable contact 4 is compressed by the above elastic reversing of the movable contact 4. The compressed air may disturb the light click feel generated upon the elastic reversing of the dome shape of the movable contact 4. For compensation, the conventional panel switch 501 has the air passage 7 which is provided between the insulating substrate 1 and the cover sheet 5 and which does not have the adhesive layer 6. When the movable contact 4 is pressed down and elastically reversed, the air beneath the movable contact 4 flows through the air passage 7 and moves into another movable contact 4 which is not pressed down. This operation prevents the air from being compressed to disturb the light click feel, thereby allowing the movable contact 4 to maintain the click feel.

In order to increase the physical strength of the panel switch 501, the adhesive layer 6 is required to have a large boding strength to have the insulating substrate 1 adhere to the cover sheet 5. In the conventional panel switch 501, the adhesive layer 6 is provided on the lower surface of the cover sheet 5 by a screen printing technique enabling a pattern to be printed to form the air passages 7. The screen printing technique is however not favorable for increasing the thickness of the adhesive layer 6, accordingly preventing the adhesive layer from having a large bonding strength.

SUMMARY OF THE INVENTION

A panel switch includes an insulating substrate, a resist layer provided on an upper surface of the insulating substrate, a cover sheet, an adhesive layer bonded onto an upper surface of the resist layer, and plural push switches activated upon being pressed via the cover sheet. The resist layer has plural contact openings and a communication opening provided therein. The contact openings and the communication opening exposes the upper surface of the insulating substrate from the contact openings and the communication opening. The communication opening allows the contact openings to communicate with each other. The adhesive layer is provided entirely on a lower surface of the cover sheet and covers the contact openings and the communication opening. The push switches are accommodated in the contact openings, respectively.

In this panel switch, the adhesive layer can easily be printed on the cover sheet and bond the cover sheet securely to the insulating substrate.

DESCRIPTION OF THE PREFERRED EMBODIMENT

Figure 1A:
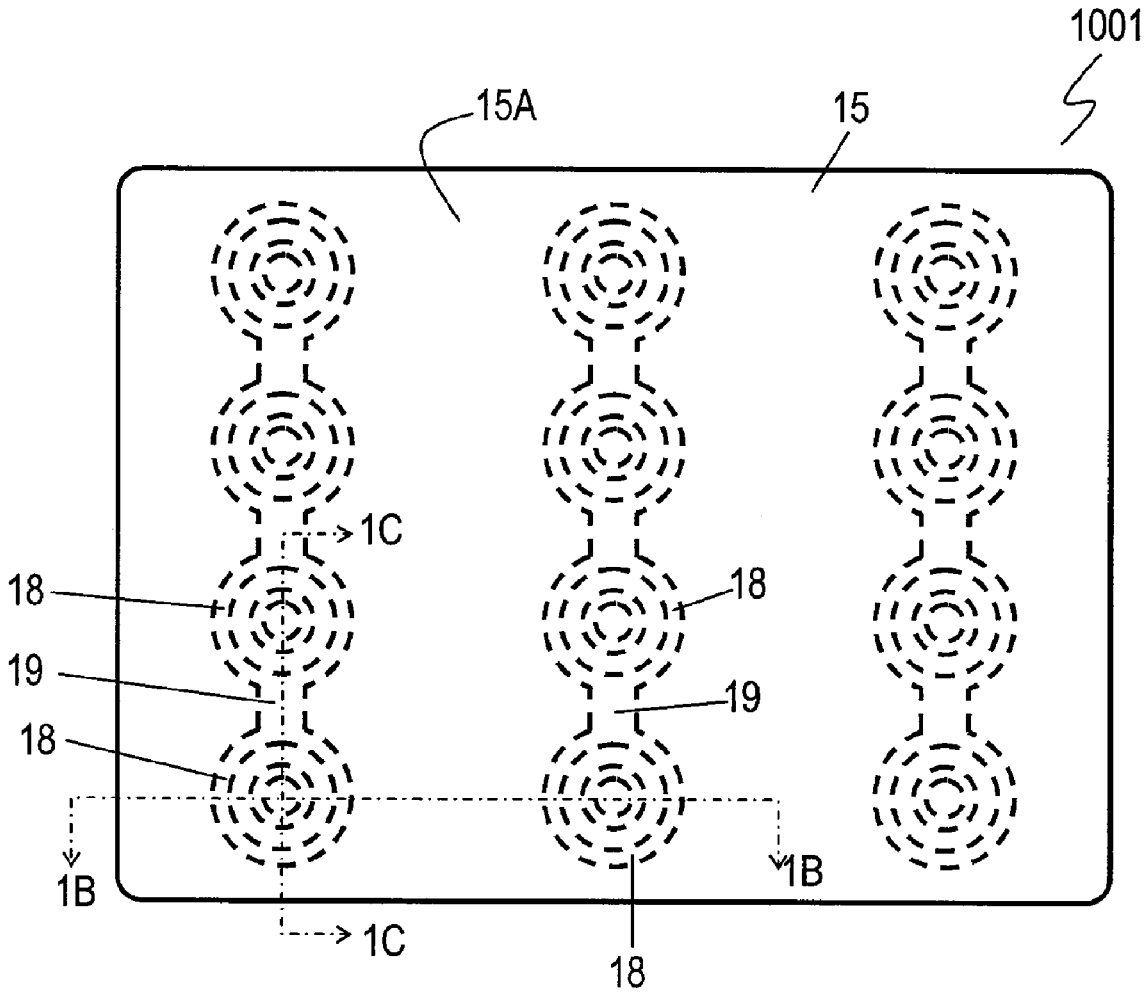
FIG. 1A is a top view of a panel switch according to an exemplary embodiment of the present invention.

FIG. 1A is an upper view of a panel switch 1001 according to an exemplary embodiment of the present invention. FIG.

Figure 1B:
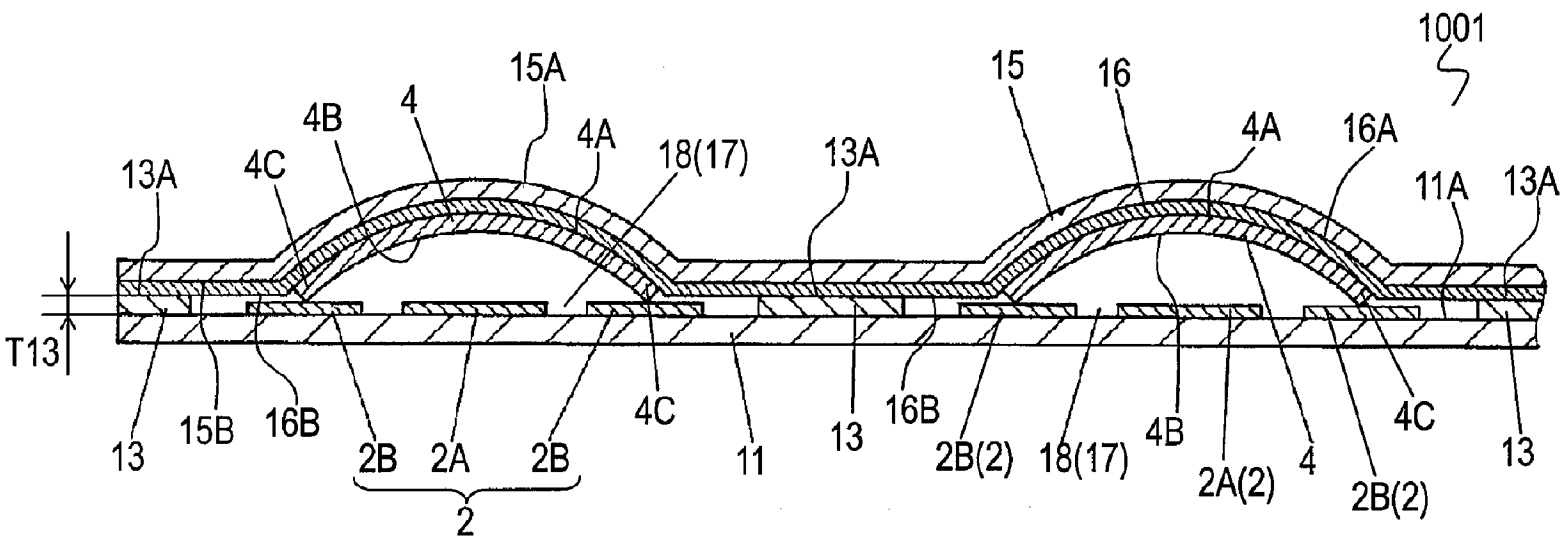
FIG. 1B is a cross sectional view of the panel switch at line 1B-1B shown in FIG. 1A.
Figure 1C:
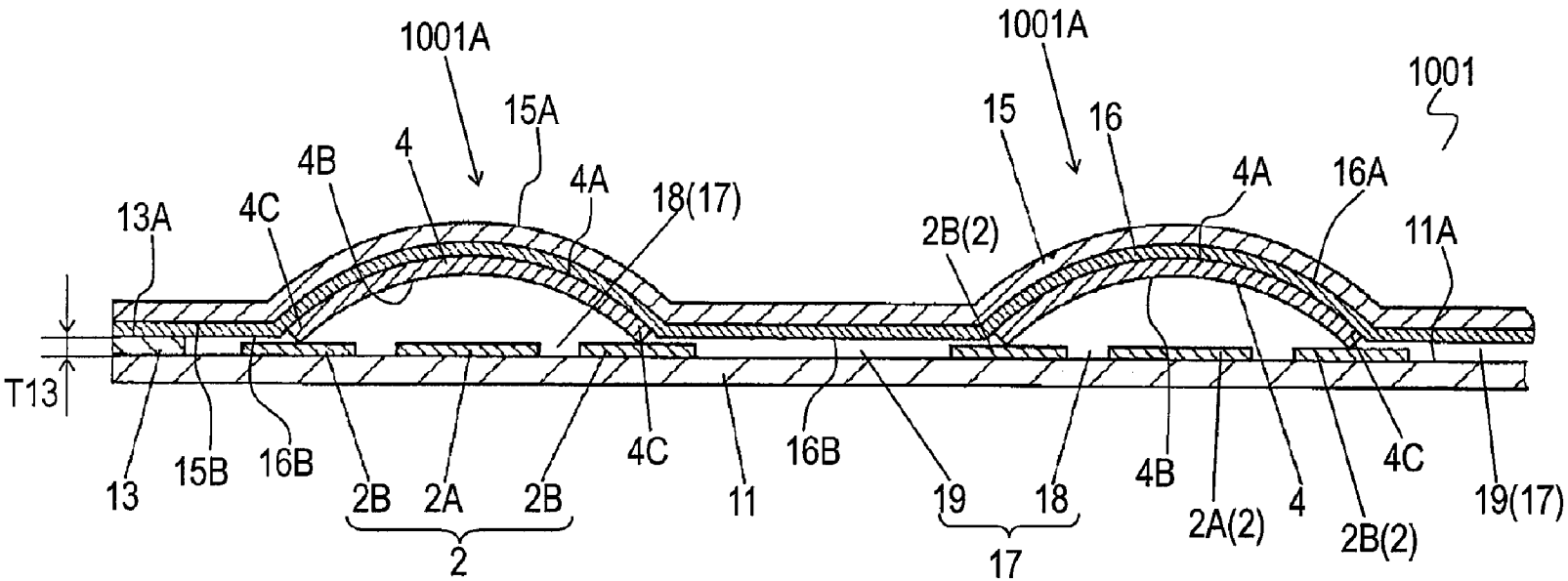
FIG. 1C is a cross sectional view of the panel switch at line 1C-1C shown in FIG. 1A.
Figure 2:
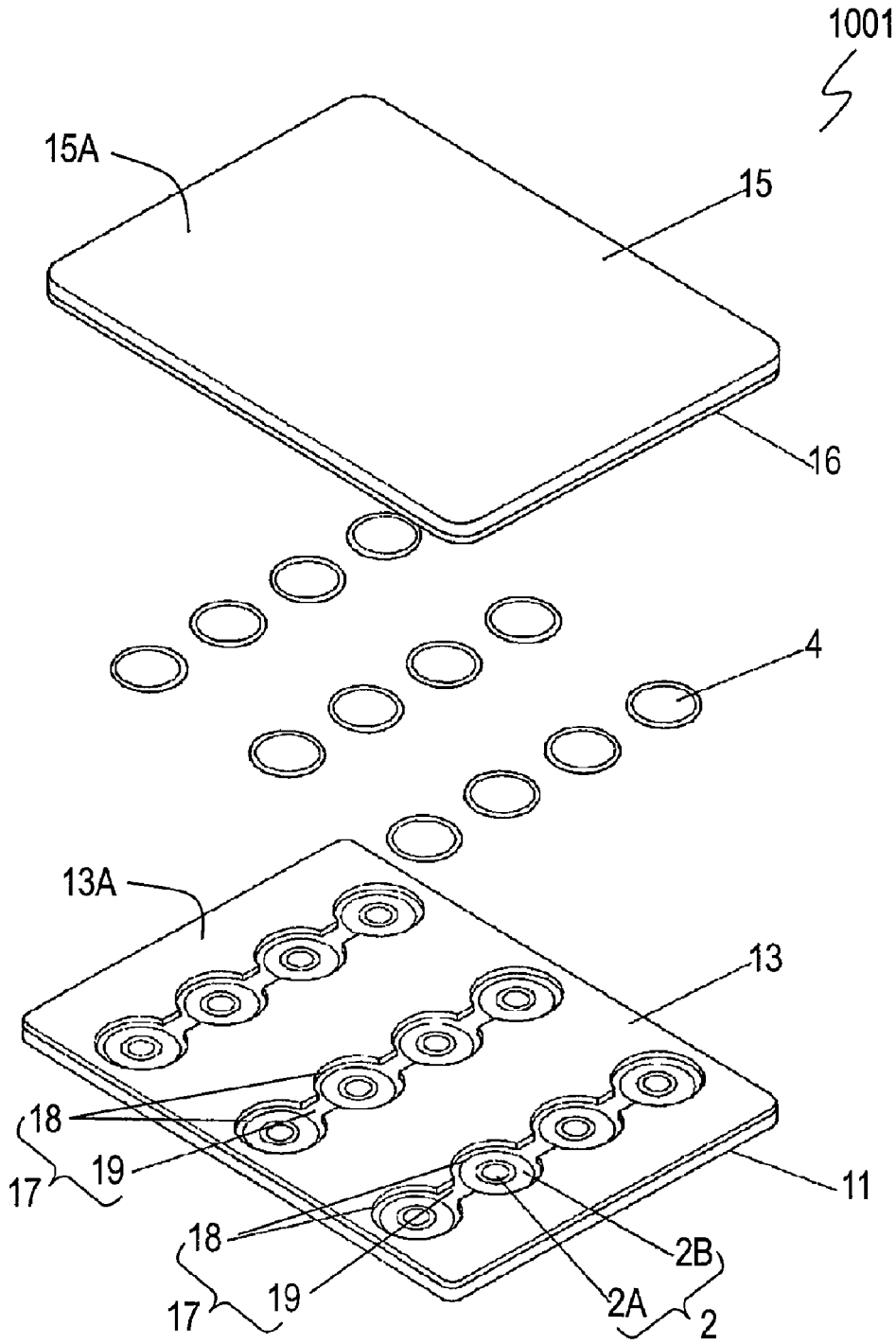
FIG. 2 is an exploded perspective view of the panel switch according to the embodiment.
Figure 3:
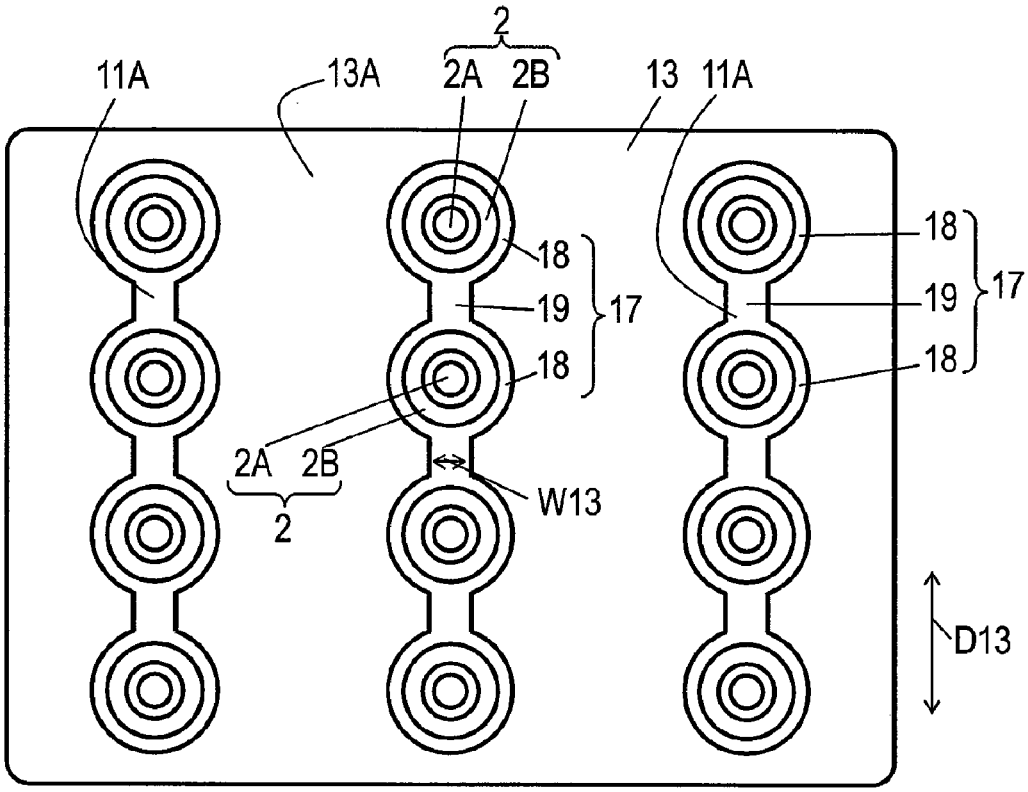
FIG. 3 is a top view of an insulating substrate of the panel switch according to the embodiment.

1B is a cross sectional view of the panel switch 1001 at line 1B-1B shown in FIG. 1A. FIG. 1C is a cross sectional view of the panel switch 1001 at line 1C-1C shown in FIG. 1A. FIG. 2 is an exploded perspective view of the panel switch 1001. FIG. 3 is a top view of an insulating substrate 11 of the panel switch 1001.

The insulating substrate 11 is made of insulating film, such as polyimide resin film, having a resistance to heat, and has a substantially rectangular shape. Plural stationary contacts 2 made of conductive material, such as copper foil or carbon, are provided on an upper surface 11A of the insulating substrate 11. Each of the stationary contacts 2 includes an inner stationary contact 2A and an outer stationary contact 2B spaced by a distance from the inner stationary contact 2A. The outer stationary contact 2B has an annular shape surrounding the inner stationary contact 2A. The stationary contact 2 including the inner stationary contact 2A and the outer stationary contact 2B may be fabricated by etching a copper foil or printing a pattern of conductive paste, such as carbon, on the upper surface 11A of the insulating substrate 11.

As shown in FIGS. 2 and 3, a resist layer 13 made of insulating resin, such as polyimide resin or polyurethane resin is provided on the upper surface 11A of the insulating substrate 11 by screen printing. The resist layer 13 itself does not have an adhering property. The resist layer 13 has a predetermined pattern and has a thickness ranging from 10 μm to 35 μm. The resist layer 13 has plural circular contact openings 18 provided therein, and has plural communication openings 19 having small width and provided therein. The upper surface 11A of the insulating substrate 11 is exposed from the contact openings 18 and the communication openings 19 in the resist layer 13 provided on the upper surface 11A of the insulating substrate 11. The stationary contacts 2 are located in the contact openings 18, respectively, and are exposed from the resist layer 13. The communication openings 19 are provided between the contact openings 18 and communicating with the contact openings 18. The contact openings 18 are have circular shapes surrounding the outer stationary contacts 2B, hence exposing the outer stationary contacts 2B completely from the contact openings 18, respectively.

The movable contacts 4 made of elastic metal are located in the contact openings 18, respectively. Each movable contact 4 has substantially a dome shape having a circular outer edge 4C, a convex upper surface 4A, and a convex lower surface 4B opposite to the upper surface 4A. The outer edge 4C of the movable contact 4 is always placed on the outer stationary contact 2B. The concave lower surface 4B of the movable contact 4 faces the inner stationary contact 2A by a distance between the movable contact 4 and the inner stationary contact 2A.

An adhesive layer 16 is provided entirely on a lower surface 15B of the cover sheet 15 having a substantially rectangular shape. That is, an upper surface 16A of the adhesive layer 16 contacts the lower surface 15B of the cover sheet 15. The cover sheet 15 is made of insulating film, such as thermoplastic polyurethane film or polyethylene terephthalate (PET) film. The adhesive layer 16 is made entirely of adhesive agent. A lower surface 16B of the adhesive layer 16 is bonded onto the upper surfaces 4A of the movable contacts 4 and the upper surface 13A of the resist layer 13 while the cover sheet 15 covers from above the insulating substrate 11 having the movable contacts 4 mounted thereto.

Each contact openings 18 exposes the upper surface 11A of the insulating substrate 11 from the openings 18, and allow the contact openings 18 to communicate with each other. While being bonded onto the upper surface 13A of the resist layer 13, the adhesive layer 16 covers the contact openings 18 and the communication openings 19 from above apart from the upper surface of the insulating substrate 11.

Figure 4:
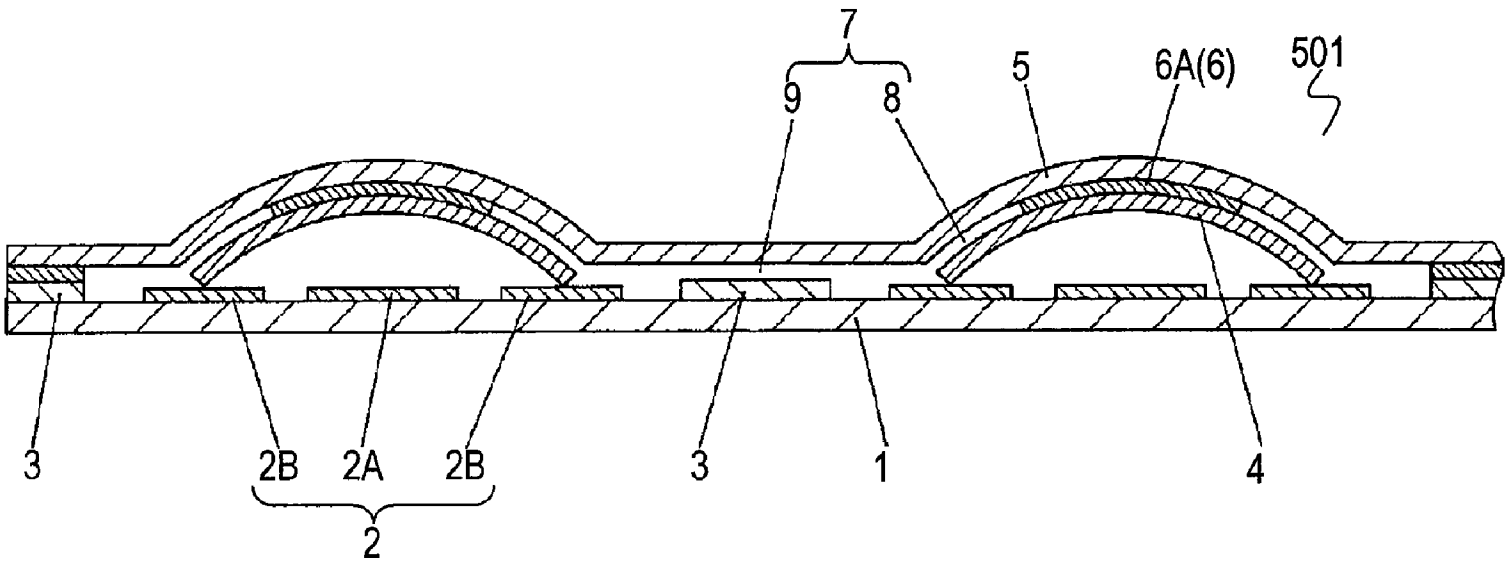
FIG. 4 is a cross sectional view of a conventional panel switch.
Figure 5:
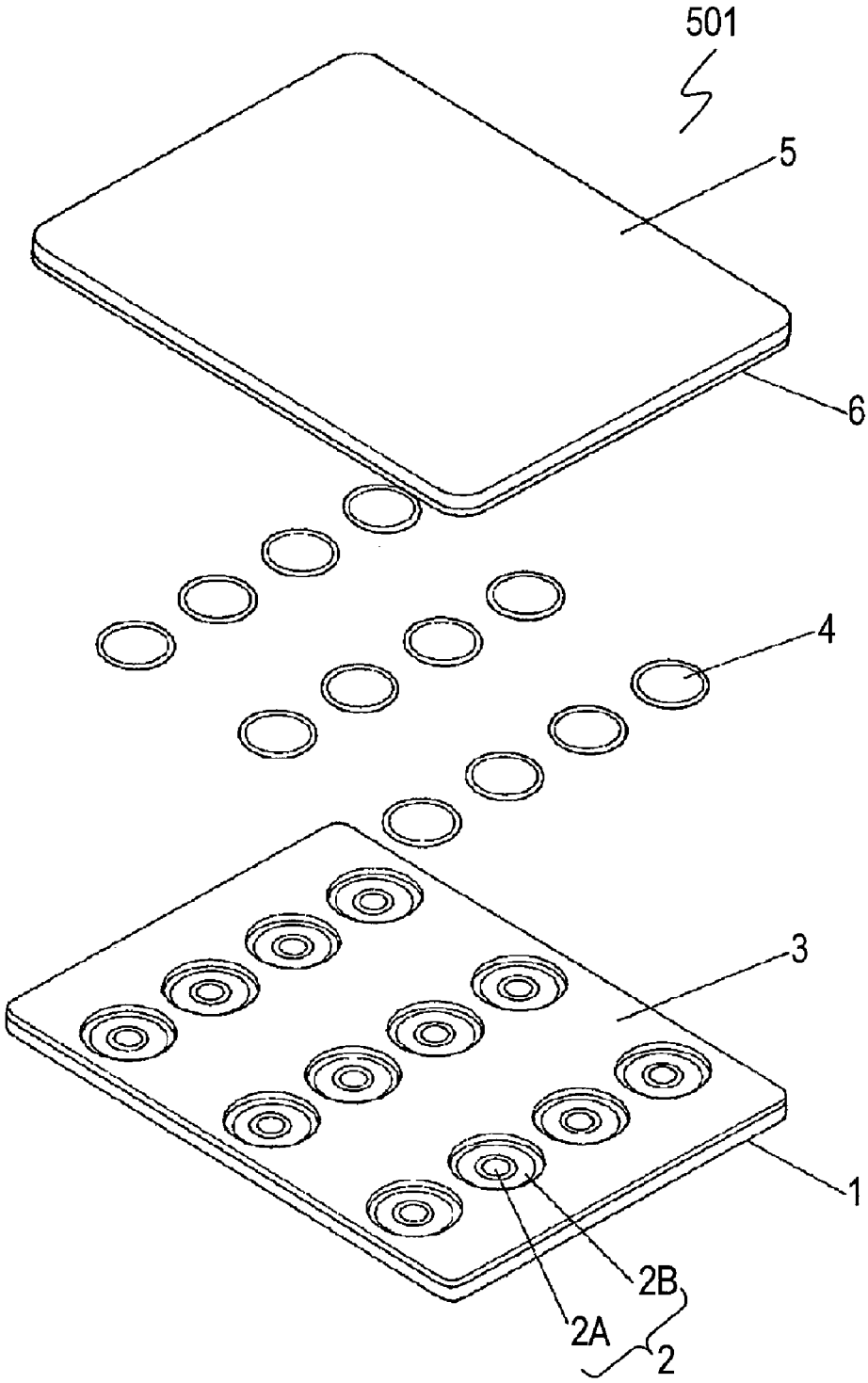
FIG. 5 is an exploded perspective view of the conventional panel switch.
Figure 6:
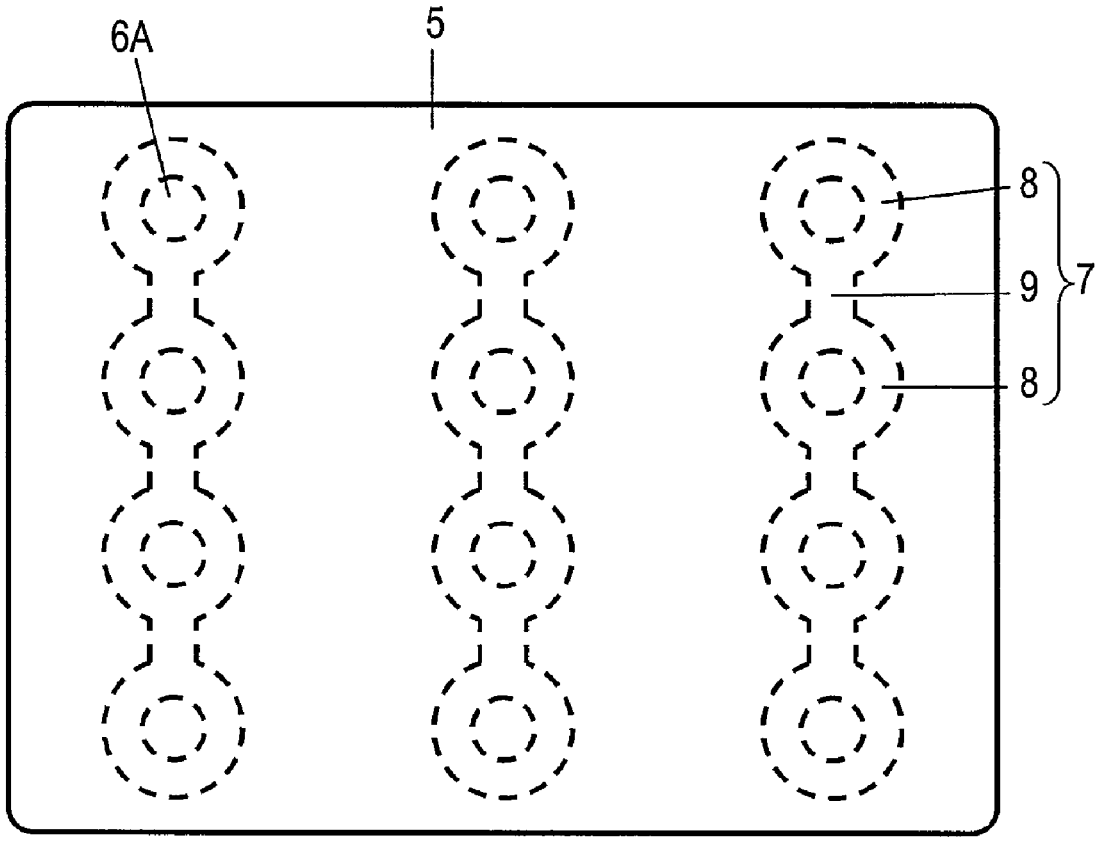
FIG. 6 is a top view of a cover sheet of the conventional panel switch.

The adhesive layer 16 can be formed by applying the adhesive agent evenly onto the lower surface 15B of the cover sheet 15, and may be printed on the lower surface 15B of the cover sheet 15 by roller coater printing. Therefore, the adhesive layer 16 can be formed less expensively than an adhesive layer 6 formed by a screen printing technique shown in FIG. 4. The roller coater printing allows the adhesive agent having a large tacking capability to form the adhesive layer 16 having a large thickness, accordingly increasing the adhering strength of the adhesive layer 16 easily.

As shown in FIG. 3, the contact openings 18 are arranged in direction D13 and communicate with each other via the communication opening 19. The width W13 of the communication opening 19 perpendicular to the direction D13 and the thickness T13 of the resist layer 13 are determined to prevent the lower surface 16B of the adhesive layer 16 from adhering onto the upper surface 11A of the insulating substrate 11 and thus to locate the lower surface 1B apart from the upper surface 11A. The contact openings 18 and the communication opening 19 form air passages 17 allowing air to flow through air passage 17. The air passages 17 are surrounded by the insulating substrate 11, the resist layer 13, and the adhesive layer 16, and the cover sheet 15 does not face the air passages 17.

Then, an operation of the panel switch 1001 will be described below. When the cover sheet 15 is pressed down at a position on an upper surface 15A corresponding to the center of the movable contact 4, a pressing force is applied to the movable contact 4. When the pressing force exceeds a predetermined level, the dome shape of the movable contact 4 is elastically reversed with a light click feel. Then, the lower surface 4B of the movable contact 4 contacts the inner stationary contact 2A to connect the inner stationary contact 2A electrically with the outer stationary contact 2B via the movable contact 4.

When the pressing force applied to the upper surface 15A of the cover sheet 15 is released, the dome shape of the movable contact 4 returns back to have its original shape being upwardly convex with a light click feel. Then, as shown in FIG. 1B, the lower surface 4B of the movable contact 4 is removed from the inner stationary contact 2A, thus disconnecting the outer stationary contact 2B electrically from the inner stationary contact 2A. As described, the movable contact 4, the inner stationary contact 2A, and the outer stationary contact 2B form a single push switch 1001A, that is, the plural movable contacts 4 and the stationary contacts 2 provide the push switches 1001A, respectively.

The push switches 1001A are accommodated in the contact openings 18, respectively, and activated by being pressed via the cover sheet 15.

Since the cover sheet 15 covers the upper surface 11A of the insulating substrate 11, the above operation compresses air between the lower surface 4B of the movable contact 4 and the upper surface 11A of the insulating substrate 11 when the movable contact 4 is elastically reversed. In the panel switch 1001, the air passage 17 is formed between the insulating substrate 11 and the adhesive layer 16. When the dome shape of the movable contact 4 is elastically reversed upon being pressed, the air beneath the movable contact 4 flows via the air passage 17 to the adjacent contact opening 15 accommodating another movable contact 4 which is not pressed. The air is compressed to a level which does not affect the generating of the light click feel so as to maintain the light click feel generated by the movable contact 4. The air passage 17 including the contact opening 18 and the communication opening 19 is surrounded by the resist layer 13, the insulating substrate 11, the adhesive layer 16, and the cover sheet 15, and thus, does not communicate with the outside of the cover sheet 15, thereby preventing dust in atmosphere from reaching the stationary contact 2.

The adhesive layer 16 can be formed by printing with a roll coater, thereby having a larger thickness than that formed by a screen printing technique and being made of adhesive material having a large tacking capability. Hence, the adhesive layer 16 bonds the cover sheet 15 securely to the insulating substrate 11 and prevents the cover sheet 15 from being peeled off from the insulating substrate 11. In the case that the adhesive layer 16 is made of material having a large tacking capability, the thickness of the adhesive layer 16 may be determined arbitrarily.

The resist layer 13 can be formed on the upper surface 11A of the insulating substrate 11 by a screen printing technique. The screen printing technique can form the contact openings 18 and the communication openings 19 communicating between the contact openings 18 with a printing pattern simultaneously to the forming of the resist layer 13. The thickness T13 of the resist layer 13 is determined within the range from 10 μm to 35 μm which allows the layer 13 to be formed by the screen printing technique, hence allowing the contact openings 18 and the communication openings 19 to be formed inexpensively and efficiently. The thickness T13 of the resist layer 13 ranges more preferably from 10 μm to 25 μm, which allows the resist layer 13 to be formed stably by a single operation of the screen printing simultaneously to the forming of the air passages 17.

The insulating substrate 11 is made of polyimide resin, being thin and flexible. This allows electronic devices including the panel switch 1001 to be thin and to be designed arbitrarily. Alternatively, the insulating substrate 11 may be made of another resin material, such as hard epoxy resin or phenol resin.

The movable contact 4 has the outer edge 2C having the circular shape, and the contact opening 18 in the resist layer 13 has the circular shape corresponding to the circular shape of the outer edge 2C of the movable contact 4. The shape of the outer edge 2C of the movable contact 4 is not limited to the circular shape, but may be another shape, such as a rectangular shape or an oval shape. In this case, the contact openings 18 may have a shape matching with the shape of the outer edge 4C of the movable contact 4. The shape and arrangement of the stationary contact 2 corresponding to the movable contact 4 are not limited to those described above. The movable contact 4 and the stationary contact 2 provide the push switch 1001A which is activated upon being pressed down via the cover sheet 15. The push switch 1001A is not limited to the combination of the movable contact 4 having the dome shape and the stationary contact 2, but may be a switch which is accommodated in the contact opening 18 and which is activated upon the cover sheet 15 being pressed to change the volume of the contact opening 18.

According to the embodiment, terms, such as "upper surface" and "lower surface", indicating directions indicate just relative directions depending upon the positions components such as which include the insulating substrate 11 and the cover sheet 15, of the panel switch 1001, and do not indicate absolute directions, such a vertical direction.

What is claimed is:

1. A panel switch comprising:

an insulating substrate having an upper surface thereof;

a resist layer absent an adhesive portion provided on the upper surface of the insulating substrate, the resist layer having a plurality of contact openings provided therein and a communication opening provided therein, the plurality of contact openings and the communication opening exposing the upper surface of the insulating substrate from the plurality of contact openings and the communication opening, the communication opening allowing the plurality of contact openings to communicate with each other;

a cover sheet having a lower surface thereof;

an adhesive layer provided entirely on the lower surface of the cover sheet and bonded onto the upper surface of the resist layer, the adhesive layer covering the contact openings and the communication opening; and a plurality of push switches accommodated in the plurality of contact openings, respectively, the plurality of the push switch being activated upon being pressed via the cover sheet.

2. The panel switch according to claim 1, wherein each of the push switches includes a stationary contact mounted on the upper surface of the insulating substrate and accommodated in each of the contact openings in the resist layer, and a movable contact made of elastic metallic material and having substantially a dome shape having a convex upper surface thereof and a concave lower surface thereof, the concave lower surface of the movable contact facing from the stationary contact by a distance.

3. The panel switch according to claim 1, wherein the resist layer has a thickness ranging from 10 μm to 35 μm.

4. The panel switch according to claim 3, wherein the resist layer is formed by a screen printing technique.

5. The panel switch according to claim 3, wherein the insulating substrate is made of insulating film.

6. The panel switch according to claim 1, wherein the insulating substrate is made of insulating film.

* * * * *